US009698483B2

(12) United States Patent
Liu et al.

(10) Patent No.: US 9,698,483 B2
(45) Date of Patent: Jul. 4, 2017

(54) AERIAL DEVICE AND METHOD FOR SETTING AERIAL DEVICE

(71) Applicant: Lenovo (Beijing) Co., Ltd., Beijing (CN)

(72) Inventors: Jin Liu, Beijing (CN); Jinqiang Lin, Beijing (CN)

(73) Assignee: LENOVO (BEIJING) CO., LTD., Haidian District, Beijing (CN)

( * ) Notice: Subject to any disclaimer, the term of this patent is extended or adjusted under 35 U.S.C. 154(b) by 143 days.

(21) Appl. No.: 14/387,034

(22) PCT Filed: Feb. 21, 2014

(86) PCT No.: PCT/CN2014/072397

§ 371 (c)(1),
(2) Date: Sep. 22, 2014

(87) PCT Pub. No.: WO2014/135012

PCT Pub. Date: Sep. 12, 2014

(65) Prior Publication Data

US 2015/0084831 A1 Mar. 26, 2015

(30) Foreign Application Priority Data

Mar. 4, 2013 (CN) ..... 2013 1 0068153

(51) Int. Cl.
*H01Q 1/24* (2006.01)
*H01Q 9/04* (2006.01)
*H01Q 21/24* (2006.01)

(52) U.S. Cl.
CPC ..... *H01Q 9/0407* (2013.01); *H01Q 1/241* (2013.01); *H01Q 1/243* (2013.01); *H01Q 21/24* (2013.01)

(58) Field of Classification Search
CPC ..... H01Q 1/243; H01Q 21/24; H01Q 9/0407
(Continued)

(56) References Cited

U.S. PATENT DOCUMENTS 3,987,458 A 10/1976 Reggia et al.
7,046,201 B2 * 5/2006 Okada ..... H01Q 1/22 343/700 MS (Continued)

FOREIGN PATENT DOCUMENTS

CN 101884135 11/2010
CN 102157799 8/2011

(Continued)

OTHER PUBLICATIONS

PCT/CN2014/072397 International Search Report dated May 19, 2014 (4 pages including English translation).

(Continued)

*Primary Examiner* — Hoanganh Le
(74) *Attorney, Agent, or Firm* — Brinks Gilson & Lione; G. Peter Nichols

(57) ABSTRACT

Provided are an aerial device applied to an electronic apparatus and corresponding method for setting the aerial device that include a first aerial unit located at the first position of the electronic apparatus, having a first communication bandwidth, and radiating a first aerial signal in a first polarization direction; and a second aerial unit located at the second position adjacent to the first position of the electronic apparatus, having a second communication bandwidth, and irradiating a second aerial signal in a second polarization direction orthogonal to the first polarization direction. In the present invention, the polarization directions of aerial signals of adjacent aerial units are orthogonalized to improve the isolation between adjacent aerial units, thus enabling different aerial units to be arranged adjacent to one another so as to reduce the footprint of an aerial device.

10 Claims, 3 Drawing Sheets

(58) Field of Classification Search
USPC ..... 343/702, 893
See application file for complete search history.

(56) References Cited

U.S. PATENT DOCUMENTS

| | | | | |
|---|---|---|---|---|
| 8,212,736 | B2 | 7/2012 | Satoh et al. | |
| 8,421,694 | B2 | 4/2013 | Iso et al. | |
| 8,531,337 | B2 * | 9/2013 | Soler Castany | H01Q 1/242 343/702 |
| 8,836,588 | B2 * | 9/2014 | Hayashi | H01Q 1/38 343/700 MS |
| 8,952,859 | B2 * | 2/2015 | Tan | H01Q 1/243 343/702 |
| 2002/0106995 | A1 * | 8/2002 | Callaway, Jr. | H01Q 1/241 455/101 |
| 2005/0266903 | A1 * | 12/2005 | Masaki | G06F 1/1616 455/575.7 |
| 2009/0315793 | A1 * | 12/2009 | Chen | H01Q 1/243 343/745 |
| 2010/0277395 | A1 | 11/2010 | Satoh et al. | |
| 2010/0297971 | A1 * | 11/2010 | Persson | H01Q 21/29 455/127.2 |
| 2011/0187616 | A1 | 8/2011 | Iso et al. | |
| 2011/0215971 | A1 * | 9/2011 | Rao | H01Q 1/243 343/702 |
| 2013/0176189 | A1 * | 7/2013 | Kodama | H01Q 1/243 343/876 |
| 2013/0257674 | A1 * | 10/2013 | Li | H01Q 5/321 343/853 |

FOREIGN PATENT DOCUMENTS

| | | |
|---|---|---|
| CN | 102623793 A | 8/2012 |
| CN | 102842751 | 12/2012 |
| CN | 202712437 U | 1/2013 |

OTHER PUBLICATIONS

First Office Action dated Oct. 10, 2015 out of priority Chinese Application No. 201310068153.5 (9 pages including English translation).

International Report on Patentability dated Sep. 8, 2015 out of priority PCT Application No. PCT/CN2014/072397 (7 pages including English translation).

Second Office Action dated May 23, 2016 out of Chinese Priority Application No. 201310068153.5 (8 pages including English translation).

Third Office Action dated Sep. 12, 2016 out of Chinese Priority Application No. 201310068153.5 (7 pages including English translation).

Office Action, and English language translation thereof, in corresponding Chinese Application No. 201310068153.5, dated Feb. 7, 2017, 10 pages.

* cited by examiner

AERIAL DEVICE AND METHOD FOR SETTING AERIAL DEVICE

This application claims priority to International Application No. PCT/CN2014/072397 filed Feb. 21, 2014, and to Chinese Application No. 201310068153.5 filed Mar. 4, 2013, the entire contents of each are incorporated herein by reference.

BACKGROUND

The present disclosure relates to the field of communications technology, and more particularly, to an antenna apparatus and a method for setting the antenna apparatus.

With the development of communications technology, working frequency bands used for communications increase gradually. Accordingly, it entails two or more numbers of antennas being set in an electronic device so that the electronic device is able to work on different working frequencies. An MIMO (multi-input multi-output) antenna system is adopted in the 3G and 4G mobile communications technologies, two or more numbers of antennas also entail being set in the MIMO antenna, so as to improve capacity and spectrum utilization of the communications system.

In the case of setting two or more antennas in a single electronic device, different antennas interfere with each other, which reduces antenna performance. Therefore, isolation between different antennas requires to be improved. Existing solutions are disposing two antennas at different positions of the electronic device separately and making them away from each other as far as possible, so as to improve isolation between different antennas. For example, the MIMO antenna is designed at an upper end and a lower end in a mobile phone, so as to improve isolation between different antenna elements of the MIMO antenna.

Separately disposing antennas in the electronic device will take up a large space, which goes against miniaturization of the electronic device. And, as the number of antennas in the electronic device increases, it is difficult to select appropriate positions for disposing the respective antennas while ensuring antenna performance. For example, when a Four-in Four-out MIMO antenna is adopted in the mobile phone, isolation requirement between four antennas cannot be met.

Therefore, it is expected to increase isolation performance between different antenna elements to reduce the interference of adjacent antennas, thereby different antennas can be placed in vicinity to save space in the electronic device.

SUMMARY

Embodiments of the present disclosure provide an antenna apparatus and a method for setting the antenna apparatus, which are capable of increasing isolation performance between different antenna elements to reduce the interference of adjacent antennas, thereby different antennas can be placed in vicinity to save space in the electronic device.

In an aspect, there is provided an antenna apparatus applied to an electronic device, the antenna apparatus comprising: a first antenna element located at a first position in the electronic device, having a first communications bandwidth, and used for radiating a first antenna signal in a first polarization direction; a second antenna element located at a second position adjacent to the first position in the electronic device, having a second communications bandwidth, used for irradiating a second antenna signal in a second polarization direction that is orthogonal to the first polarization direction.

In the antenna apparatus, the first communications bandwidth is a high frequency bandwidth larger than a predetermined frequency, and the second communications bandwidth is a low frequency bandwidth lower than the predetermined frequency.

In the antenna apparatus, the second position is an end edge of a main circuit board in the electronic device, a relative position between the first antenna element and the second antenna element corresponds to the orthogonal of the first polarization direction and the second polarization direction.

In addition, the antenna apparatus may further comprise: a third antenna element located at a third position in the electronic device, and used for radiating a third antenna signal in a third polarization direction; and a ground unit located between the first antenna element and the third antenna element.

In the antenna apparatus, the third antenna element is used for radiating a third antenna signal in a third polarization direction, the antenna apparatus further comprises: a fourth antenna element located at a fourth position adjacent to the third position in the electronic device, and used for radiating a fourth antenna signal in a fourth polarization direction that is orthogonal to the third polarization direction.

In the antenna apparatus, the first antenna element has a first feeding terminal, the third antenna element has a third feeding terminal, and a size of the ground unit corresponds to a distance between the first feeding terminal and the third feeding terminal.

In the antenna apparatus, at least one of the first antenna element and the second antenna element is a ceramics antenna.

In another aspect, there is provided a method for setting an antenna apparatus applied to an electronic device, the method comprising: disposing a first antenna element at a first position in the electronic device, the first antenna element having a first communications bandwidth and being used for radiating a first antenna signal in a first polarization direction; disposing a second antenna element at a second position adjacent to the first position in the electronic device, the second antenna element having a second communications bandwidth and being used for irradiating a second antenna signal in a second polarization direction that is orthogonal to the first polarization direction.

In the method for setting an antenna apparatus, the first communications bandwidth is a high frequency bandwidth larger than a predetermined frequency, and the second communications bandwidth is a low frequency bandwidth lower than the predetermined frequency.

In the method for setting an antenna apparatus, the step of disposing a second antenna element at a second position adjacent to the first position in the electronic device comprises: disposing the second antenna element at an end edge of a main circuit board in the electronic device, wherein a relative position between the first antenna element and the second antenna element corresponds to the orthogonal of the first polarization direction and the second polarization direction.

The method for setting an antenna apparatus may further comprise: disposing a third antenna element located at a third position in the electronic device, and used for radiating a third antenna signal in a third polarization direction; and disposing a ground unit located between the first antenna element and the third antenna element.

In the method for setting an antenna apparatus, the third antenna element is used for radiating a third antenna signal in a third polarization direction, the method further comprises: disposing a fourth antenna element at a fourth position adjacent to the third position in the electronic device, the fourth antenna element being used for radiating a fourth antenna signal in a fourth polarization direction that is orthogonal to the third polarization direction.

In the method for setting an antenna apparatus, the first antenna element has a first feeding terminal, the third antenna element has a third feeding terminal, and the step of disposing a ground unit located between the first antenna element and the third antenna element comprises: determining a size of the ground unit based on a distance between the first feeding terminal and the third feeding terminal; and disposing the ground unit in accordance with the determined size.

In the method for setting an antenna apparatus, at least one of the first antenna element and the second antenna element is a ceramics antenna.

In the above antenna apparatus and the method for setting the antenna apparatus described in the embodiments of the present disclosure, isolation between adjacent antenna elements is improved by making the polarization directions of antenna signals of adjacent antenna elements be orthogonal, thereby different antennas can be placed in vicinity to save space occupied by the antenna apparatus.

BRIEF DESCRIPTION OF THE DRAWINGS

In order to more clearly explain the technical solutions of the embodiments of the present disclosure, drawings necessary for descriptions of the embodiments and the prior art will be described briefly below, obviously, the drawings described below merely are some embodiments of the present disclosure, it is also possible for a person with ordinary skill in the art to obtain other drawings based on these drawings without paying creative efforts.

DETAILED DESCRIPTION

Hereinafter, the technical solutions in the embodiments of the present disclosure will be described clearly and comprehensively in combination with the drawings in the embodiments of the present disclosure, obviously, these described embodiments are parts of the embodiments of the present disclosure, rather than all of the embodiments thereof.

In the antenna apparatus and the method for setting the antenna apparatus in the embodiments of the present disclosure, isolation performance between antenna elements is improved by utilizing irrelevance of space layout (antenna signals whose polarization directions are orthogonal have no correlation), thus meeting the requirement of isolation needed for a normal operation between adjacent antenna elements, and thereby different antennas can be placed in vicinity to save space occupied by the antenna apparatus.

Figure 1:
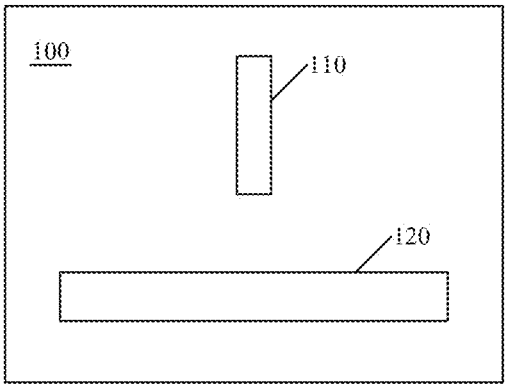
FIG. 1 schematically illustrates a block diagram of structure of an antenna apparatus according to an embodiment of the present disclosure.

FIG. 1 is a block diagram illustrating structure of an antenna apparatus 100 according to an embodiment of the present disclosure. The antenna apparatus 100 may be applied to various electronic devices, such as a mobile communications terminal, a tablet computer, a notebook computer, a base station, etc., types of the electronic devices do not constitute a limitation to the present disclosure.

The antenna apparatus 100 comprises: a first antenna element 110 located at a first position in the electronic device, having a first communications bandwidth, and used for radiating a first antenna signal in a first polarization direction; a second antenna element 120 located at a second position adjacent to the first position in the electronic device, having a second communications bandwidth, and used for irradiating a second antenna signal in a second polarization direction that is orthogonal to the first polarization direction.

Any of the first antenna element 110 and the second antenna element 120 may be an antenna element implemented using any technology, such as an Inverted-F Antenna (IFA), a microstrip antenna, a monopole antenna, a loop antenna etc. Specific types of antennas do not constitute a limitation to the present disclosure.

Antenna polarization is for describing spatial directionality at which an antenna radiates electromagnetic waves, and since an electric field and a magnetic field have a constant relationship, usually spatial directionality of an electric field vector is taken as a polarization direction at which an antenna radiates electromagnetic waves. With the ground as a parameter, the direction of the electric field vector parallel to the ground is called a horizontal polarization, and the direction of the electric field vector vertical to the ground is called a vertical polarization. The horizontal polarization and the vertical polarization direction are two polarization directions orthogonal to each other.

The first antenna element 110 is located at a first position in the antenna apparatus 100, has a first communications bandwidth, and is used for radiating a first antenna signal in a first polarization direction. The first communications bandwidth may be a high frequency bandwidth (i.e., high frequency bands typically occupied when performing voice and data communications) greater than a predetermined frequency (e.g., 800 MHz, 1500 MHz, etc.). As an example, the working frequency band of the first antenna element 110 may be for example 824-960 MHz or 1710-2170 MHz.

The first antenna element 110 may be implemented by adopting any manufacturing art. As an example, it may be a ceramic antenna or a Flexible Printed Circuit (FPC) antenna. In the case that the first antenna element 110 is a ceramic antenna, it is possible to reduce the volume of or the space occupied by the first antenna element 110, facilitate massive production, and control its polarization direction accurately.

In addition, the polarization direction of the antenna signal of the first antenna element 110 may be, for example, the horizontal polarization direction, or the vertical polarization direction, and may also be any other desired direction. The first antenna element 110 may be located at any position of the electronic device, in practice, it is possible to flexibly design according to requirements.

The second antenna element 120 may be an antenna element the same as or different than the first antenna element 110, it is located at a second position adjacent to the first position in the electronic device, has a second communications bandwidth, and is used for irradiating a second antenna signal in a second polarization direction that is orthogonal to the first polarization direction.

As an example, when the first antenna signal of the first antenna element 110 is in the horizontal polarization direction, the second antenna signal of the second antenna element 120 is in the vertical polarization direction; when the first antenna signal of the first antenna element 110 is in the vertical polarization direction, the second antenna signal of the second antenna element 120 is in the horizontal polarization direction, as long as the second polarization direction is orthogonal to the first polarization direction. Since the second polarization direction is orthogonal to the first polarization direction, even if the first antenna signal and the second signal meet, they can still continue to propagate along their own signal paths without interfering with each other, thereby enhancing the isolation between the first antenna element 110 and the second antenna element 120. In this way, the first position of the first antenna element 110 and the second position of the second antenna element 120 may be made adjacent, thereby saving the space occupied by the antenna apparatus 100.

The communications bandwidth of the second antenna element 120 may be the same as or different than that of the first antenna element 110. That is, frequencies of the antenna signals of the first antenna element 110 and the second antenna element 120 may be the same or different. As described above, since the polarization direction of the second antenna signal of the second antenna element 120 is orthogonal to the polarization direction of the first antenna signal of the first antenna element 110, even if frequencies of the antenna signals of the first antenna element 110 and the second antenna element 120 are the same, the two also have a good isolation between them.

In the actual communications environment, the polarization direction of the first antenna signal or the second antenna signal may possibly alter due to being reflected, interfered. In this case, if the second communications bandwidth is different than the first communications bandwidth, the frequencies of the first antenna signal and the second antenna signal are different, the interference between the two can be reduced. As an example, when the first communications bandwidth is a high frequency bandwidth larger than a predetermined frequency, the second communications bandwidth is a low frequency bandwidth lower than the predetermined frequency. Alternatively, when the first communications bandwidth may be a low frequency bandwidth lower than the predetermined frequency, the second communications bandwidth may be a high frequency bandwidth larger than the predetermined frequency.

The lower the frequency of the antenna signal is, the longer the wiring of the antenna element is, and the more space it will occupy. In the case that the second communications bandwidth is different than the first communications bandwidth, it is possible to properly select the first position where the first antenna element 110 is located in the electronic device and the second position where the second antenna element 120 is located in the electronic device in conjunction with range of the frequency bands. With the first communications bandwidth being the high frequency bandwidth and the second communications bandwidth being the low frequency band lower than the predetermined frequency as example, the second position may be an end edge of a main circuit board in the electronic device (e.g., a lower left corner, a lower right corner, a top left corner, a top right corner etc. of the main circuit board), the end portion of the main circuit board usually has a gap with a housing of the electronic device, so as to provide more headroom for the second antenna element 120, to ensure its radiation and bandwidth performance.

For the realization of the orthogonal polarization directions of the first antenna element 110 and the second antenna element 120, in addition to designing when manufacturing the antenna elements, it is also possible to adjust a relative positional relationship between the first antenna element 110 and the second antenna element 120. As an example, as shown in FIG. 1, if the polarization direction of the first antenna element 110 is along its longitudinal direction and the polarization direction of the second antenna element 120 is also along its longitudinal direction, then it is possible to make the polarization directions of the two perpendicular by causing the first antenna element and the second antenna element to be vertical to each other. That is, the first antenna element and the second antenna element may be located in the end portion perpendicularly to each other.

The second antenna element 120 may be implemented by adopting any manufacturing art. As an example, it may be a ceramic antenna or a Flexible Printed Circuit (FPC) antenna. In the case that the second antenna element 120 is a ceramic antenna, it is also possible to reduce the volume of or the space occupied by the second antenna element 120, facilitate massive production, and control its polarization direction accurately.

In the above antenna apparatus of the embodiment of the present disclosure, isolation between the adjacent antenna elements is improved by making the polarization directions of antenna signals of the adjacent first antenna element 110 and second antenna element 120 be orthogonal, thereby different antennas can be placed in vicinity to save space occupied by the antenna apparatus.

Besides, based on the measure of reducing interference between antenna elements by using orthogonal polarization directions as described above, other measures for improving isolation between antenna elements may be also combined, to enable that a plurality of antenna elements can be set in a single electronic device. For example, it is possible to place other antenna elements at positions sufficiently far from the first antenna element 110 and the second antenna element 120; and it is also possible to improve isolation between respective antenna elements by adopting a ground unit. Improving isolation between antenna elements through distance apartness has been widely used, no more details repeated herein. How to improve isolation between respective antenna elements by adopting the ground unit will be described below in conjunction with FIG. 2.

Figure 2:
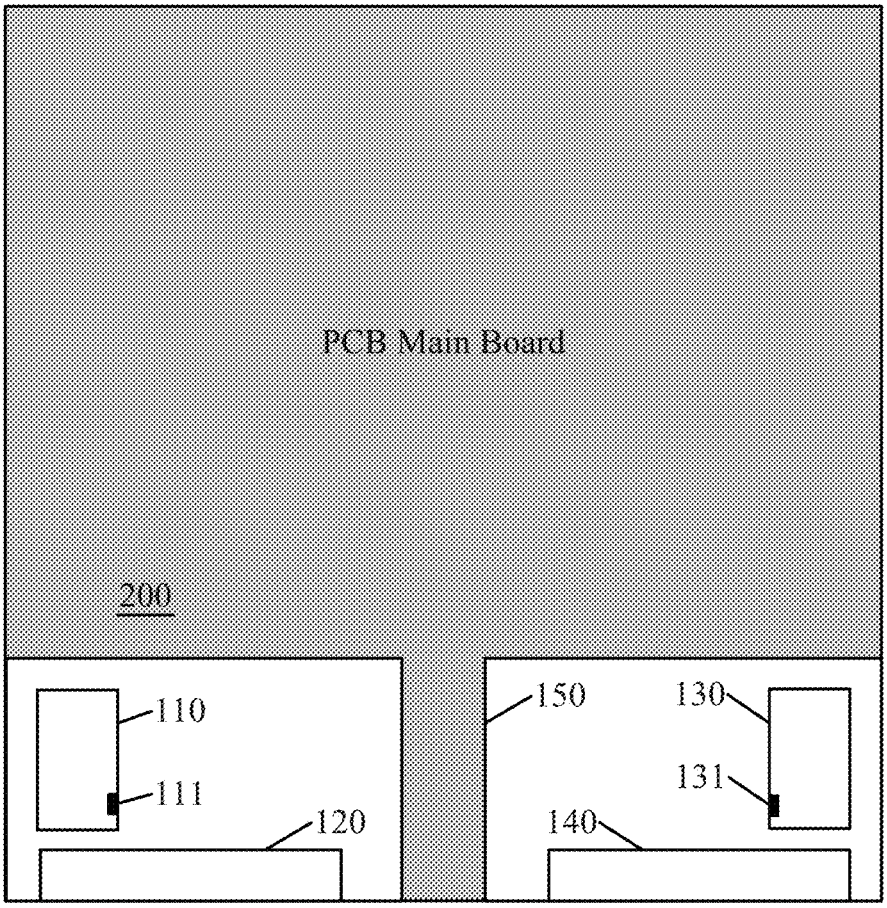
FIG. 2 schematically illustrates a block diagram of structure of an antenna apparatus according to another embodiment of the present disclosure.

FIG. 2 schematically illustrates a block diagram of structure of an antenna apparatus 200 according to another embodiment of the present disclosure.

The antenna apparatus 200 may comprise four antenna elements, a first antenna element 110, a second antenna element 120, a third antenna element 130, and a fourth antenna element 140. The first antenna element 110 and the second antenna element 120 in FIG. 2 are the same as those in FIG. 1, no more description is provided herein. Although in FIG. 2, in addition to the first antenna element 110 and the second antenna element 120, the antenna apparatus 200 further comprises the third antenna element 130 and the fourth antenna element 140, the antenna apparatus 200 may comprise only one of the third antenna element 130 and the fourth antenna element 140, to meet different antenna needs.

As an example, in addition to the first antenna element 110 and the second antenna element 120, the antenna apparatus 200 may further comprise the third antenna element 130 located at a third position in the electronic device and used for radiating a third antenna signal in a third polarization direction; a ground unit 150 located between the first antenna element 110 and the third antenna element 130. The communications bandwidth, the polarization direction of the antenna signal, and the type and so on of the third antenna element 130 do not constitute a limitation to the present disclosure. In addition, the third antenna element 130 may be a ceramic antenna.

The ground unit 150 is located between the first antenna element 110 and the third antenna element 130, thus forming a physical isolation for the two antenna elements, and thereby separates the signals leaked in a feeding terminal of the first antenna element 110 (the first feeding terminal 111 shown in FIG. 2) and a feeding terminal of the third antenna element 130 (the third feeding terminal 131 shown in FIG. 2), which improves the isolation. Furthermore, the ground unit 150 may alter a strike of currents in the first feeding terminal 111 and the third feeding terminal 131, for example, make part of the currents in the first feeding terminal 111 and the third feeding terminal 131 flow to the ground unit 150, when interference of mirror signals is generated in the first antenna element 110 and the third antenna element 130, the currents that flow to the ground unit 150 of the first feeding terminal 111 and the third feeding terminal 131 may generate phases opposite to each other, so that they can partially or even completely counteract, thereby reducing the mutual interference of the antenna signals in free space. That is, the ground unit 150 not only physically isolates the first antenna element 110 and the third antenna element 130, and also alters the strike of the currents in the first antenna element 110 and the third antenna element 130, thereby changes a coupling relationship between the first antenna element 110 and the third antenna element 130, so that currents that interfere mutually can partially counteract, thus improving the isolation between the first antenna element 110 and the third antenna element 130.

A size (e.g., length, width, etc.) of the ground unit 150 corresponds to a distance between the first feeding terminal 111 and the third feeding terminal 131. When the distance between the first feeding terminal 111 and the third feeding terminal 131 is far, the mutual interference will be small, then the size of ground unit 150 may be relatively small; when the distance between the first feeding terminal 111 and the third feeding terminal 131 is close, the size of ground unit 150 may be increased to improve its area for enhancing the isolation effect. The length of the ground unit 150 may be greater than or equal to a length of any of the two feeding terminals so as to form a good physical isolation.

In the case that the radiation performance of the first antenna element 110 and that of the third antenna element 130 are the same, the first feeding terminal 111 and the third feeding terminal 131 may be located symmetrically at both sides of the ground unit 150, so that mirror currents in the first antenna element 110 and the third antenna element 130 can counteract much more. In the case that the radiation performance of the first antenna element 110 and that of the third antenna element 130 are different, it is also possible to adjust the position of the first feeding terminal 111 and the third feeding terminal 131 relative to the ground unit 150 to attain an optimal interaction effect.

By setting the size and position of the ground unit 150, it is also possible to improve the isolation between the second antenna element 120 and the third antenna element 130, like between the first antenna element 110 and the third antenna element 130. In practice, the ground unit 150 may be a part of a substrate of the electronic device, which for example is a part of a ground layer of the main processing circuit board of the electronic device.

Further, the antenna apparatus 200 may further comprise a fourth antenna element 140 located at a fourth position adjacent to the third position in the electronic device and used for radiating a fourth antenna signal in a fourth polarization direction that is orthogonal to the third polarization direction. The fourth antenna element 140 has a large volume because of its low communications frequency, it may be placed at an end edge (i.e., a lower right corner) of the main circuit board (i.e., PCB board), as shown in FIG. 2.

The polarization directions of the antenna signals of the fourth antenna element 140 and the third antenna element 130 are also orthogonal, like between the first antenna element 110 and the second antenna element 120, so that the isolation between the two can be improved. The ground unit 150 may also be used to isolate between the fourth antenna element 140 and the first antenna element 110, the second antenna element 120. The fourth antenna element 140 and the second antenna element 120 may be symmetrically located at both sides of the ground unit 150, in order to achieve good isolation performance. In the Long-Term-Evolution communications system, any of the fourth antenna element 140 and the second antenna element 120 may be 5 mm away from the ground unit 150, thus ensuring a minimum requirement of the isolation of −10 dB. In addition, the fourth antenna element 140 may be a ceramic antenna.

In the above antenna apparatus 200 of the embodiment of the present disclosure, isolation between different antenna elements is improved by combining the use of different antenna isolation technologies, i.e., orthogonally arranging the polarization directions of the antenna signals of the adjacent antenna elements, and adding the ground unit between the antenna elements, so that a plurality of antenna elements can be placed in vicinity so as to save the space occupied by the antenna apparatus.

Figure 3:
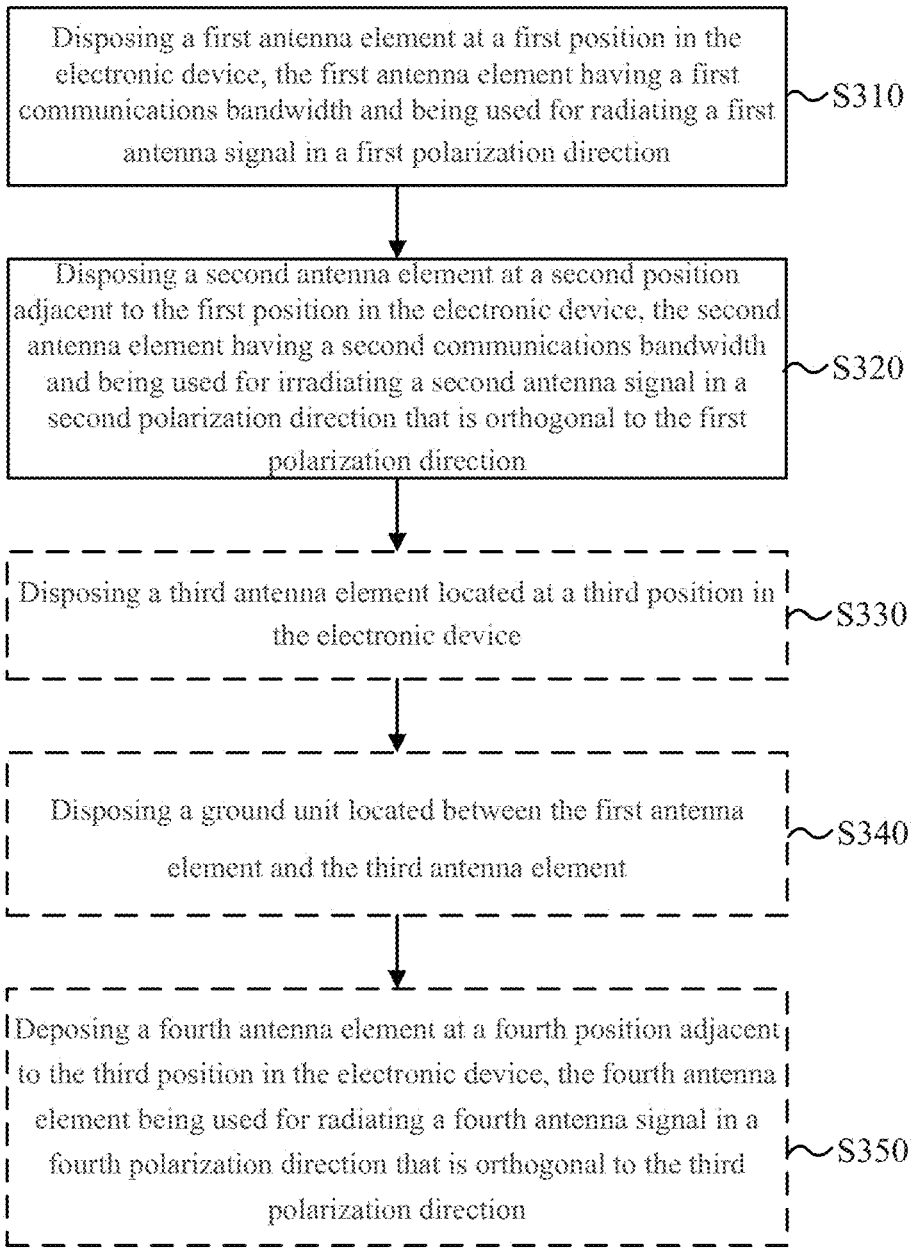
FIG. 3 shows a flowchart of a method for forming an antenna apparatus according to an embodiment of the present disclosure.

FIG. 3 is a flowchart illustrating a method 300 for forming an antenna apparatus according to an embodiment of the present disclosure. The antenna apparatus set by using the method 300 may be applied to various electronic devices, the types of electronic devices do not constitute a limitation to the present disclosure.

The method 300 for setting an antenna apparatus comprises: disposing a first antenna element at a first position in the electronic device, the first antenna element having a first communications bandwidth and being used for radiating a first antenna signal in a first polarization direction (S310); and disposing a second antenna element at a second position adjacent to the first position in the electronic device, the second antenna element having a second communications bandwidth and being used for irradiating a second antenna signal in a second polarization direction that is orthogonal to the first polarization direction (S320).

The first antenna element disposed in S310 and the second antenna element disposed in S320 may be an antenna element implemented using any technology, such as a microstrip antenna, a monopole antenna, a loop antenna, an Inverted-F Antenna (IFA) etc. Specific types of antennas do not constitute a limitation to the present disclosure. In terms of manufacturing art, the first antenna element or the second antenna element may be a ceramic antenna or a Flexible Printed Circuit (FPC) antenna or an antenna manufactured in any other art. In the case of adopting the ceramic antenna, it is possible to reduce the volume of or the space occupied by the antenna element, facilitate massive production, and control its polarization direction accurately. In the embodiment of the present disclosure, the frequency bandwidth of any of the first antenna element and the second antenna element does not constitute a limitation to the present disclosure, for example, the first communications bandwidth and the second communications bandwidth may be a high frequency bandwidth greater than a predetermined frequency (for example, 800 MHz, 1500 MHz etc.), and the second communications bandwidth may be a low frequency bandwidth lower than the predetermined frequency bandwidth, the following description is provided with the latter as an example.

In S310, a first antenna element is disposed at a first position in the electronic device, the first antenna element having a first communications bandwidth and being used for radiating a first antenna signal in a first polarization direction. As an example, the polarization direction of the antenna signal of the first antenna element may be a horizontal polarization direction, or a vertical polarization direction, and may also be any other desired direction. In addition, in practice, it is possible to flexibly design the first position according to requirements.

In S320, a second antenna element is disposed at a second position adjacent to the first position in the electronic device, the second antenna element having a second communications bandwidth and being used for irradiating a second antenna signal in a second polarization direction that is orthogonal to the first polarization direction.

Since the second polarization direction is orthogonal to the first polarization direction, even if the first antenna signal and the second signal meet, they can still continue to propagate along their own signal paths without interfering with each other, thereby enhancing the isolation between the first antenna element and the second antenna element. Even if frequencies of the antenna signals of the first antenna element and the second antenna element are the same, the two also have a good isolation between them. Of course, when the frequencies of the antenna signals of the first antenna element and the second antenna element are different, common-frequency interference between the first antenna element and the second antenna element can be avoided, thereby further enhancing the isolation between different antenna elements.

S320 may comprise: disposing the second antenna element at an end edge of a main circuit board in the electronic device, the second antenna element being vertical to the first antenna element.

The lower the frequency of the antenna signal is, the longer the wiring of the antenna element is, and the more space it will occupy. The end portion of the main circuit board usually has a gap with a housing of the electronic device, so as to provide more headroom for a large antenna element, to ensure its radiation and bandwidth performance. In the case that the first communications bandwidth is the high frequency bandwidth and the second communications bandwidth is the low frequency bandwidth lower than the predetermined frequency, disposing the second antenna element that occupies a large space at an end edge of the main circuit board can make full use of the space of the electronic device and ensure the irradiation and bandwidth performance thereof.

For the realization of the orthogonal polarization directions of the first antenna element and the second antenna element, in addition to designing when manufacturing the antenna elements, it is also possible to adjust a relative positional relationship between the first antenna element and the second antenna element. Thus, it is possible to make the polarization directions of the two perpendicular by causing the first antenna element and the second antenna element to be vertical to each other.

As for the structure of the antenna apparatus formed with S310 and S320, the illustration of FIG. 1 may be consulted, wherein isolation between different antenna elements is improved by making the polarization directions of different antenna elements orthogonal, so that different antenna elements can be placed in vicinity so as to save the space occupied by the antenna apparatus.

Besides, based on the measure of reducing interference between antenna elements by using orthogonal polarization directions in S310 and S320, other measures for improving isolation between antenna elements may be also combined, to enable that a plurality of antenna elements can be set in a single electronic device. For example, it is possible to set a plurality of antenna elements in a single electronic device by increasing a distance between antenna elements; and it is also possible to improve isolation between respective antenna elements by adopting a ground unit. Improving isolation between respective antenna elements by adopting the ground unit will be described below.

Alternatively, the method 300 for setting an antenna apparatus as shown in FIG. 3 may further comprise: disposing a third antenna element located at a third position in the electronic device, and used for radiating a third antenna signal in a third polarization direction (S330); disposing a ground unit located between the first antenna element and the third antenna element (S340); disposing a fourth antenna element at a fourth position adjacent to the third position in the electronic device, the fourth antenna element being used for radiating a fourth antenna signal in a fourth polarization direction that is orthogonal to the third polarization direction (S350). As can be seen, the ground unit is set to isolate the first antenna element and the third antenna element.

The third antenna element disposed in S330 is independent of the first antenna element and the second antenna element, hence, none of its communications bandwidth, polarization direction, type, manufacturing art etc. constitutes a limitation to the present disclosure. The third antenna element may be for example a ceramic antenna.

The ground unit disposed in S340 is located between the first antenna element and the third antenna element, thus forming a physical isolation for the two antenna elements, and thereby separates the signals leaked in a feeding terminal of the first antenna element (hereinafter referred to as the first feeding terminal) and a feeding terminal of the third antenna element (hereinafter referred to as the third feeding terminal), which improves the isolation. Furthermore, the ground unit disposed in S340 may alter a strike of currents in the first feeding terminal and the third feeding terminal, for example, make part of the currents in the first feeding terminal and the third feeding terminal flow to the ground unit, when interference of mirror signals is generated in the first antenna element and the third antenna element, the currents that flow to the ground unit of the first feeding terminal and the third feeding terminal may generate phases opposite to each other, so that they can partially or even completely counteract, thereby reducing the mutual interference of the antenna signals in free space. That is, the ground unit not only physically isolates the first antenna element and the third antenna element, and also alters the strike of the currents in the first antenna element and the third antenna element, thereby changes a coupling relationship between the first antenna element and the third antenna element, so that currents that interfere mutually can partially counteract, thus improving the isolation between the first antenna element and the third antenna element.

The S340 may comprise: determining a size of the ground unit based on a distance between the first feeding terminal and the third feeding terminal; and disposing the ground unit in accordance with the determined size. When the distance between the first feeding terminal and the third feeding terminal is far, the mutual interference will be small, then the size of ground unit may be relatively small; when distance between the first feeding terminal and the third feeding terminal is close, the size of ground unit may be increased to improve its area for enhancing the isolation effect. The length of the ground unit may be greater than or equal to a length of any of the two feeding terminals so as to form a good physical isolation.

In the case that the radiation performance of the first antenna element and that of the third antenna element are the same, the first feeding terminal and the third feeding terminal may be located symmetrically at both sides of the ground unit, so that mirror currents in the first antenna element and the third antenna element can counteract much more. In the case that the radiation performance of the first antenna element and that of the third antenna element are different, it is also possible to adjust the position of the first feeding terminal and the third feeding terminal relative to the ground unit to attain an optimal interaction effect.

By setting the size and position of the ground unit, it is also possible to improve the isolation between the second antenna element and the third antenna element, like between the first antenna element and the third antenna element. In addition, it is also possible to dispose the ground unit between the second antenna element and the fourth antenna element to improve the isolation between the two. The ground unit may be a part of a substrate of the electronic device, which for example is a part of a ground layer of the main processing circuit board of the electronic device.

The polarization directions of the antenna signals of the fourth antenna element disposed in S350 and the third antenna element disposed in S330 are also orthogonal, like between the first antenna element and the second antenna element, so that the isolation between the two can be improved. The ground unit may also be used to isolate between the fourth antenna element and the first antenna element, the second antenna element. The fourth antenna element and the second antenna element may be symmetrically located at both sides of the ground unit, in order to achieve good isolation performance. In the Long-Term-Evolution communications system, any of the fourth antenna element and the second antenna element may be 5 mm away from the ground unit, thus ensuring a minimum requirement of the isolation of −10 dB. In addition, the fourth antenna element may also be a ceramic antenna.

It should be noted that an addition and a deletion may be made to the steps in FIG. 3 as necessary, or an order of the respective steps therein may be adjusted. For example, in the realization of a Three-in Three-out MIMO antenna, step S350 may be deleted from FIG. 3.

As for the structure of the antenna apparatus formed with S310 to S350 in FIG. 3, the illustration of FIG. 2 and the description provided in conjunction with FIG. 2 can be consulted.

In the above method for setting an antenna apparatus of the embodiment of the present disclosure, isolation between different antenna elements is improved by combining the use of different antenna isolation technologies, i.e., orthogonally arranging the polarization directions of the antenna signals of the adjacent antenna elements, and adding the ground unit between the antenna elements, so that a plurality of antenna elements can be placed in vicinity so as to save the space occupied by the antenna apparatus.

As will be clearly appreciated by those skilled in the art that, for convenience and brevity of description, as for the specific implementations of the apparatus and elements, units, involved in the above method for setting an antenna apparatus, the preceding illustration and operations in the above apparatus embodiment can be consulted, no more details discussed herein.

In the several embodiments provided by the present application, it should be understood that the disclosed apparatus and method may be realized by other ways. For example, some of the steps in the above method embodiment may be re-combined, or an execution order among some of the steps therein may be changed.

The above described are merely specific implementations of the present disclosure, but the protection scope of the present disclosure is not limited thereto, variations or alternatives that are readily conceivable for those skilled in the art within the technical range disclosed by the present disclosure should all fall into the protection scope of the present disclosure. Therefore, the protection scope of the present disclosure should be construed as the protection scope of the claims.

The invention claimed is:

1. An antenna apparatus applied to an electronic device, the antenna apparatus comprising:

a first antenna element located at a first position in the electronic device, having a first communications bandwidth, and used for radiating a first antenna signal in a first polarization direction;

a second antenna element located at a second position adjacent to the first position in the electronic device, having a second communications bandwidth, and used for irradiating a second antenna signal in a second polarization direction that is orthogonal to the first polarization direction;

a third antenna element located at a third position in the electronic device, and used for radiating a third antenna signal in a third polarization direction; and a ground unit located between the first antenna element and the third antenna element;

wherein the first antenna element has a first feeding terminal, the third antenna element has a third feeding terminal, a size of the ground unit corresponds to a distance between the first feeding terminal and the third feeding terminal, such that the smaller the distance, the larger the size of the ground unit.

2. The antenna apparatus according to claim 1, wherein the first communications bandwidth is a high frequency bandwidth larger than a predetermined frequency, and the second communications bandwidth is a low frequency bandwidth lower than the predetermined frequency.

3. The antenna apparatus according to claim 2, wherein the second position is an end edge of a main circuit board in the electronic device, a relative position between the first antenna element and the second antenna element corresponds to the orthogonal of the first polarization direction and the second polarization direction.

4. The antenna apparatus according to claim 1, wherein the third antenna element is used for radiating a third antenna signal in a third polarization direction, the antenna apparatus further comprises:

a fourth antenna element located at a fourth position adjacent to the third position in the electronic device, and used for radiating a fourth antenna signal in a fourth polarization direction that is orthogonal to the third polarization direction.

5. The antenna apparatus according to claim 1, wherein at least one of the first antenna element and the second antenna element is a ceramics antenna.

6. A method for setting an antenna apparatus applied to an electronic device, the method comprising:

disposing a first antenna element at a first position in the electronic device, the first antenna element having a first communications bandwidth and being used for radiating a first antenna signal in a first polarization direction; and disposing a second antenna element at a second position adjacent to the first position in the electronic device, the second antenna element having a second communications bandwidth and being used for irradiating a second antenna signal in a second polarization direction that is orthogonal to the first polarization direction, disposing a third antenna element located at a third position in the electronic device, and used for radiating a third antenna signal in a third polarization direction; and disposing a ground unit located between the first antenna element and the third antenna element, wherein the first antenna element has a first feeding terminal, the third antenna element has a third feeding terminal, and the step of disposing a ground unit located between the first antenna element and the third antenna element comprises:

determining a size of the ground unit based on a distance between the first feeding terminal and the third feeding terminal, such that the smaller the distance, the larger the size of the ground unit; and disposing the ground unit in accordance with the determined size.

7. The method according to claim 6, wherein the first communications bandwidth is a high frequency bandwidth larger than a predetermined frequency, and the second communications bandwidth is a low frequency bandwidth lower than the predetermined frequency.

8. The method according to claim 7, wherein the step of disposing a second antenna element at a second position adjacent to the first position in the electronic device comprises:

disposing the second antenna element at an end edge of a main circuit board in the electronic device, wherein a relative position between the first antenna element and the second antenna element corresponds to the orthogonal of the first polarization direction and the second polarization direction.

9. The method according to claim 6, wherein the third antenna element is used for radiating a third antenna signal in a third polarization direction, the method further comprises:

disposing a fourth antenna element at a fourth position adjacent to the third position in the electronic device, the fourth antenna element being used for radiating a fourth antenna signal in a fourth polarization direction that is orthogonal to the third polarization direction.

10. The method according to claim 6, wherein at least one of the first antenna element and the second antenna element is a ceramics antenna.

* * * * *